United States Patent [19]

Sieradzki

[11] Patent Number: 4,549,168

[45] Date of Patent: Oct. 22, 1985

[54] REMOTE STATION MONITORING SYSTEM

[76] Inventor: Ryszard Sieradzki, 142 Woodview Ct. #396, Rochester, Mich. 48063

[21] Appl. No.: 539,485

[22] Filed: Oct. 6, 1983

[51] Int. Cl.[4] ..... G08B 25/00; G08B 29/00

[52] U.S. Cl. ..... 340/525; 340/509; 340/511; 340/518

[58] Field of Search ..... 340/525, 517, 518, 505, 340/506, 510, 511, 509

[56] References Cited

U.S. PATENT DOCUMENTS

| | | | |
|---|---|---|---|
| 3,665,399 | 5/1972 | Zehr et al. | 340/518 |
| 3,988,730 | 10/1976 | Valker | 340/518 |
| 4,001,785 | 1/1977 | Miyazaki et al. | 340/518 |
| 4,222,041 | 9/1980 | Von Tomkewitsch et al. | 340/517 |

*Primary Examiner*—Donnie L. Crosland

*Attorney, Agent, or Firm*—Gifford, VanOphem, Sheridan, Sprinkle & Nabozny

[57] ABSTRACT

A device for monitoring the condition of a plurality of remote stations is particularly suited for monitoring the condition of smoke alarms, television antitheft devices and the like in hotels and similar institutions. The device includes a plurality of remote sensors wherein each sensor has a predetermined electrical characteristic, such as a predetermined electrical resistance, and at least one remote sensor is associated with each remote station. A main control unit sequentially measures the electrical characteristic of each of the sensors and then compares the measured electrical characteristic from the sensors with a predetermined value. In the event that the measured value differs from the predetermined value by more than a preset amount, an indicator is activated which advises an operator which sensor, and thus which remote station, has been activated or tampered with thus requiring investigation.

7 Claims, 4 Drawing Figures

Fig-2
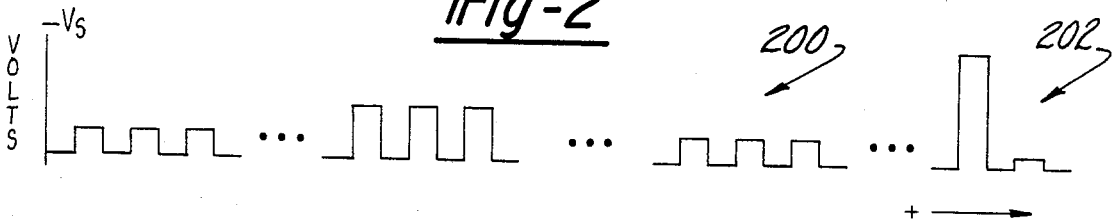
Fig-3
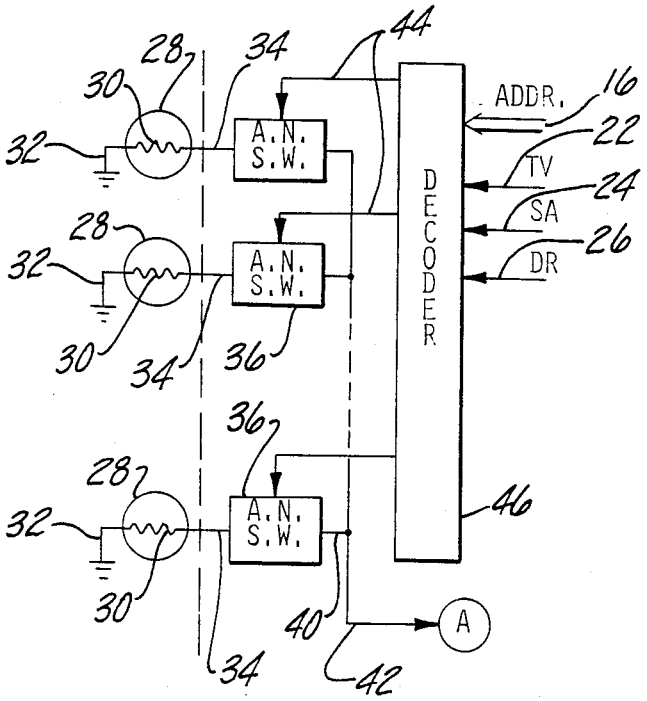
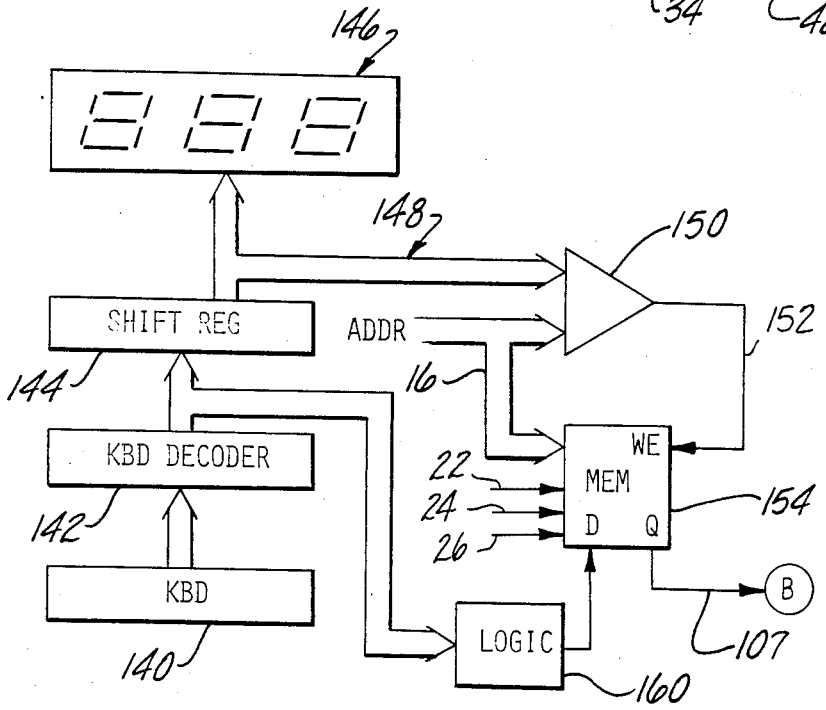
Fig-4

REMOTE STATION MONITORING SYSTEM

BACKGROUND OF THE INVENTION

I. Field of the Invention

The present invention relates generally to electronic monitoring systems and, particularly, to a monitoring system which monitors the status of a plurality of remote stations.

II. Description of the Prior Art

Hotels and similar institutions are plagued by the theft of expensive appliances, such as television sets, from the hotel room. There have been a number of previously known devices to minimize the theft of such appliances from the hotel room but none of these previously known devices have proven wholly effective in operation.

In one previously known device, one end of a resistor is secured to an electrical ground in the appliance while the other end of the resistor is electrically connected by a wire to a main station. At the main station, the resistor in the appliance forms a part of an electrical bridge, such as a Wheatstone brige, so that any tampering with the resistor sensor such, as would occur if the wire were cut, upsets the balance of the electric bridge. An indicator light at the main station is then activated once the bridge balance and has been upset to alert the operator of the possible theft of the appliance.

These previously known devices, however, suffer from a number of disadvantages. First, a skilled thief can tamper with the sensor to maintain the resistance of the sensor the same and permit the removal of the appliance without setting off the alarm. A still further disadvantage of these previously known devices is that each sensor requires a separate indicator light at the main station so that, for large hotels, the main station control panel is not only large and unsightly in appearance but also expensive in construction.

Another common problem with hotels and similar institutions is that newly enacted regulations often require the hotel to place a smoke detector alarm in each hotel room. The previously known systems would require the installation of a system completely separate from the appliance antitheft system.

A further problem associated with hotels and similar institutions are burglary of other property from hotel rooms in which the lawful occupants are not present. There are no systems known to the applicant for monitoring the hotel rooms against unexpected and unlawful entry into the hotel room.

SUMMARY OF THE PRESENT INVENTION

The present invention provides a system which overcomes all of the above-mentioned disadvantages of the previously known systems.

In brief, the system of the present invention comprises a main station which monitors the condition of a plurality of remote sensors wherein each sensor has a predetermined electrical characteristic, such as a predetermined resistance. Preferably, the main station includes a clock and pulse generator which generates a voltage pulse sequentially to each of the sensors and then measures the voltage drop across the sensor through a voltage divider. If the measured voltage is within predefined limits, the next pulse of the pulse train is electrically connected to the next sensor and the previously described process is repeated until all sensors have been tested whereupon the process is repeated.

Conversely, in the event that the voltage from the sensor falls outside predetermined limits, as would occur when the sensor has been tampered with, the main station activates a display indicating the number associated with the tampered sensor.

The primary advantage of the present invention can be employed not only to monitor antitheft sensors of the type commonly placed in appliances such as television sets, but can also be used to monitor the condition of individual smoke alarms in the hotel rooms as well as sensors to monitor the opening of the hotel door during an unauthorized entry.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 2 is a view of the signal wave form used by the device of the present invention;

FIG. 3 is a schematic view showing a further portion of the preferred embodiment of the invention; and FIG. 4 is a schematic view showing still a further portion of the preferred embodiment of the present invention.

DETAILED DESCRIPTION OF A PREFERRED EMBODIMENT OF THE PRESENT INVENTION

Figure 1:
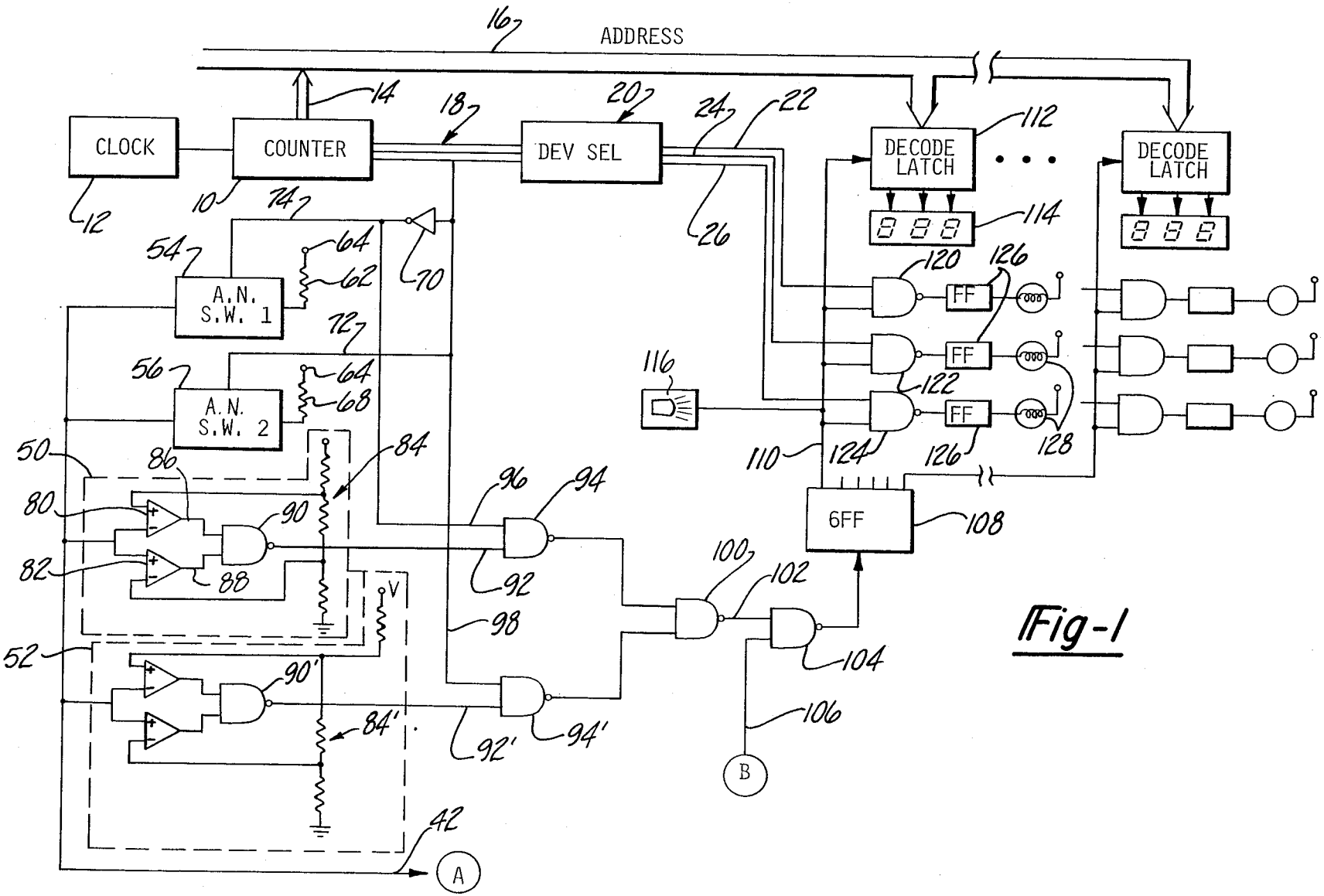
FIG. 1 is a schematic view illustrating a portion of the embodiment of the invention.

The monitoring system of the present invention will be described for use in a hotel having one thousand rooms and where it is desired to monitor the possible theft of a television set, the condition of a smoke alarm and the opening of a hotel door so that three separate conditions for each hotel room are monitored by the system. It will be understood, of course, that the system of the present invention can be used to monitor other or more of fewer conditions of the hotel room and that more or fewer hotel rooms can be so monitored without deviation from the spirit or scope of the present invention.

With reference then to FIG. 1, a portion of the main station of the monitoring system is thereshown and comprises a counter 10 which is continuously incremented by a clock 12 between zero and a maximum count whereupon the process is repeated. A first group of outputs 14 from the counter 10 form an address buss 16 for the system and, for the above described example generates an address between zero and 1,000. Four higher output data lines 18 from the counter 10 are fed as inputs to an address decoder 20 having three outputs 22, 24 and 26. Only one of the three outputs 22, 24 and 26 from the decoder 20 are active at a given time. In addition, as will shortly be described in greater detail, a television antitheft sensor is monitored by the system when the line 22 is high, the smoke alarm sensor is monitored when the line 24 is high and the door opening sensor is monitored when the line 26 is high for room number represented by the address on the address buss 16.

With reference now to FIG. 3, a sensor 28 (only three shown) is provided for each condition which is to be monitored by the system of the present invention. Each sensor 28 comprises a resistor 30 having one end 32 secured to an electrical ground and its other end 34 secured to an analog switch 36. Consequently, one sensor 28 is secured to the television set in each hotel room and other sensor 28 monitors the condition of the resistor 30 in a smoke alarm in which the resistor 30 changes in value when the smoke alarm is activated and, similarly, one sensor 28 is mounted to the door of the hotel room so that its resistance changes upon opening of the door.

The other pole 40 of each analog switch 36 are secured together in a common line 42 and each switch 36 includes an enable control line 44. Thus, when the control input 44 of an analog switch 36 is active, the analog switch 36 is closed thus electrically connecting the sensor 28 and resistor 30 associated with that analog switch 36 to line 42. Conversely, when the control line 44 of any analog switch 36 is deactivated, the analog switch 36 is open thus electrically disconnecting its associated sensor 28 from the line 42.

Still referring to FIG. 3, a decoder circuit 46 receives both the address buss 16 and the select lines 22, 24 and 26 as inputs. The decoder circuit 48 has a plurality of outputs, each of which is connected to the enable control line 44 of the analog switches 36.

The decoder circuit 46, which can be of any conventional construction, decodes its input as defined by the value on the address line 16, which can correspond to the room number of the hotel, as well as the select lines 22, 24 and 26 to activate only one control line 44 in a given time frame. Consequently, by this construction, only one analog switch 36 is activated at any given time so that only one sensor 28 and its associated resistor 32 is electrically connected to the common line 42 at a given time.

Referring again to FIG. 1, the line 42 from the analog switches 36, and thus from the sensors 28, is electrically as an input signal to two voltage comparator circuits 50 and 52. The voltage comparator circuits 50 and 52 will be subsequently described in greater detail.

Still referring to FIG. 1, a pair of analog switches 54 and 56 each have one pole electrically connected to the line 42 and thus also to the inputs to the comparator circuits 50 and 52. The other pole of the first analog switch 54 is connected through a resistor 62 to a voltage source 64. Similarly, the other pole of the second analog switch 56 is connected through a second resistor 68 to the voltage source 64. The resistor 62 and 68, however, are not of the same value so that the voltage drop across the resistor 62 will differ from the resistor 68 assuming the same current.

An inverter 70 has its input secured to the highest order bit from the counter 10 and also to the enable control line 72 of the second analog switch 56. Conversely, the output from the inverter 70 is electrically connected to the enable control line 74 of the first analog switch 54. Consequently, as the counter 10 counts upward through the first half of its maximum count, the first analog switch 54 is activated by the inverter 70 thus electrically connecting the resistor 62 between the inputs to the comparators 50 and 52 and the power source 64. Conversely, during the second half of the count, the inverter 70 deactivates the first switch 54, activates the second switch 56 and electrically connects the second resistor 68 between the voltage source 64 and the inputs to the comparators 50 and 52.

Still referring to FIG. 1, the first comparator circuit 50 comprises two separate voltage comparators 80 and 82 and each comparator 80 and 82 has both an inverting and noninverting input. The line 42 from the sensors 28 are connected to the inverting input on one comparator 80 and the noninverting input on the comparator 82. The other inputs of the comparators 80 and 82 are electrically connected to a voltage divider circuit 84 which sets the upper voltage level of one comparator 80 and the lower voltage level of the other comparator 82. Thus, the comparator 82 generates an output signal on its output line 86 only when the voltage on its input line 42 exceeds a predetermined amount, such as five volts, while the comparator 82 generates a signal on its output line 88 only when the voltage level on the line 42 falls below a predetermined amount, such as four volts. The comparator output lines 86 and 88 form inputs to a NAND gate 90 and the output 92 from the NAND gate is coupled as an input to a NAND gate 94. Consequently, the NAND gate 90 produces an output signal on its line 92 only when the voltage on the line 42 to the first comparator 50 falls outside the voltage range determined by the voltage divider 84.

The second comparator 52 is substantially the same as the first comparator 50 except that the resistors used in its voltage divider 84' are of different values than the voltage divider in the first comparator circuit 50. Consequently, the NAND gate 90' in the second comparator circuit 52 generates a signal on its output line 92' to the input of a NAND gate 94' only when the voltage level on the line 42 falls outside a second predetermined range, such as between three and four volts.

The second input of the NAND gate 94 is coupled by a line 96 to the output of the inverter 70 while, conversely, the second input of the NAND gate 94' is coupled by a line 98 to the input of the inverter 70. Consequently, the NAND gate 94 is activated only when the first analog switch 54 is activated and thus only when the resistor 62 is connected between the voltage source 64 and the inputs to the comparator circuits 50 and 52. Conversely, the NAND gate 94' is activated only when the second analog switch 66 is active, or turned on, and thus only when the second resistor 68 is connected in series between the voltage source 64 and the inputs to the comparator circuits 50 and 52.

The first analog switch 54, when closed, electrically connects the resistor 62 and the sensor resistor 30 (FIG. 3) as selected by the decoder circuit 46 in series between the voltage source 64 and ground thus forming a voltage divider circuit. The voltage at the node between the resistor 62 and the sensor resistor 30 is measured by the first voltage comparator circuit 50 to determine whether the measured voltage lies within a first predetermined voltage range. If so, the NAND gate 90 does not produce an output on its output line 92. Conversely, if the voltage to the input of the first comparator 50 is outside the predetermined range as determined by the voltage divider circuit 94, the NAND gate 90 produces an output on output its line 92 which is gated, through the NAND gate 94 to a NAND gate 100. The NAND gate 94' is disabled by the the line 98 so that any output signal on the NAND output line 92' is disregarded.

Conversely, activation of the second analog switch 56 electrically connects the second resistor 68 in series with the sensor resistor 30 selected by the decoder circuit 46 and the node between the resistor 68 and the selected sensor resistor 30 is fed as an input signal to the second comparator circuit 52. If the voltage level to the second comparator circuit 52 falls outside the voltage range determined by the voltage divider 84', the output signal from the NAND gate 90' is gated through the NAND gate 94' and to the NAND gate 100. Consequently, a signal on the output line 102 from the NAND gate 100 is indicative that the sensor resistor 30 selected by the address buss 16 and select lines 22, 24 and 26 has been removed or otherwise tampered with.

The provision of the two analog switches 54 and 56 which are selected in the mutually independent fashion and form two independent voltage divider circuits each complete with its own voltage comparator 50 and 52, respectfully, effectively prevents even the most sophisticated intruder from bypassing the sensor resistor 30 and escaping detection. In addition, FIG. 2 illustrates at 200 the wave form present at the inputs to the comparator circuits 50 and 52 in the event the sensors 28 are properly connected. The wave form at 202 illustrates the same wave form in the event that the sensors 28 have been removed or tampered with.

Referring again to FIG. 1, the output 102 from the NAND gate 100 forms an input a further NAND gate 104 having a second input line 106. Assuming that the line 106 is active (high), the output from the NAND gate 100 is gated through the NAND gate 104 and to the clock input of six sequential flip flops 108. Assuming that the flip flops 108 are initially preset to zero, a pulse from the NAND gate 104 sets the first input line 110 of the flip flop 108 to an active state. This output line 110 is connected to a decode/latch assembly 112 which also receives the count in the counter 10 from the address line 16 as an input. The count in the counter 10 is representative of the room number of the sensor 28 which has been tampered with and this number is displayed by an indicator 114, such as an LCD or LED display. The line 110 is also preferably connected to an audible signal generator 116 of any conventional construction.

Still referring to FIG. 1, the output line 110 from the flip flop 108 is also connected to one input of three NAND gates 120, 122 and 124. The control line 22 forms the other input for the first NAND gate 120 the control line 24 forms the second input for the NAND gate 122 and the control line 26 forms the other input for the third NAND gate 124. The outputs from the NAND gates 120, 122 and 124 are coupled through three individual flip flops 126 and each flip flop 126 is connected to its own individual indicator light 128. By this construction, the indicator 114 displays the room number containing the removed or tampered sensor 28 while the indicator lamps 128 provide an indication of whether the tampered sensor is the television antitheft sensor, the smoke alarm sensor or the door open sensor.

Each of the six flip flops in the flip flop circuit 108 is electrically connected to its individual display 114 and indicator lamps 128 although only two such circuits are shown in FIG. 1. Consequently, the monitoring system of the present invention is capable of detecting and displaying six different occurrences of sensors which have been removed or otherwise tampered with. It will be understood, of course, that the flip flop circuit 108 can contain more or fewer flip flops, each having their own display circuit, without deviation from the spirit or scope of the present invention.

With reference now particularly to FIG. 4, in many instances it is desirable to disable one or more particular sensors 28. For example, if a television set is removed for servicing, the sensor removed with the television should be disabled in order to prevent an erroneous display by the indicator circuits 114 and 128. Likewise, if it is not desired to monitor the door entry sensor, for example when the room is occupied by guests who enter and leave at will, disabling the door entry sensor associated with that particular occupied room is necessary to prevent erroneous display on the indicator circuits 114 and 128.

With reference now particularly to FIG. 4, in the preferred form of the invention, the system includes a keyboard 140 which, through a keyboard decoder 142, loads a shift register 144 with the room number for the sensor and sensor type to be disabled. This room number is then shown by a display 146 such as a LED or LCD display.

The output 148 from the shift register 144 is also fed as an input signal to a comparator circuit 150 having its output 152 compared to the write enable (WE) line of a random access memory (RAM) unit 154. The 154 is of sufficient size so that at least one bit is associated with each sensor 28 in the system. The address buss 16 is also fed as an input to both the comparator circuit 150 as well as the RAM 154. The select lines 22, 24 and 26 are connected to the higher order address lines of the RAM 154.

Referring now to FIGS. 1 and 4, the line 106 to the NAND 104 gate is connected to the data output 107 from the RAM 154. The RAM 154 is initially preset so that its data output 107 is in a high state so that all pulses from the NAND gate 100 are gated through the NAND gate 104 and to the flip flop circuit 108. Conversely, if it is desired to disable a particular sensor, a logic circuit 160 decodes the logic circuit output from the keyboard 140 and the output is connected to the data input for the RAM 154. The logic circuit 160 together with the keyboard 140 thus enables the operator to selectively set or reset individual data bits in the RAM 154. Consequently, assuming that a preselected sensor is disabled for any desired reason, when the address buss contains the address of the disabled sensor, the data output on line 106 from the RAM 154 disables the NAND gate 104 (FIG. 1) and precludes the display of the disabled sensor on the indicator circuits 128 and 114.

In operation and assuming that all of the sensors 28 are properly connected, all the bits in the RAM 154 which correspond to the sensors 28 are set to a predetermined value so that the data output on the line 106 from the RAM 154 activates the NAND gate 104 and gates all pulses from the NAND gate 100 to the flip flop circuit 108. However, since all the sensors and connected and operational, the voltage drops across the sensor resistors 30 as measured by the comparators 50 and 52 will fall within the expected range so that no pulses are gated through the NAND gate 100. Consequently, none of the flip flops in the flip flop circuit 108 are set by the NAND gate 104.

If the operator desires to disable a particular sensor 28 for example as required for servicing, then the operator enters both the room number and sensor type from the keyboard 140 to set the memory bit in the RAM 154 to a predetermined value. This predetermined value is selected to so that, whenever the disabled sensor is selected by the decoder circuit 46, the data output from the RAM 154 on line 106 disables the NAND gate 104 and prevents any erroneous display on the display circuit 109.

Conversely, in the event that a sensor is removed or otherwise altered or tampered with, the voltage drop across the tampered sensor will fall outside the expected voltage ranges determined by the comparators 50 and 52. Thus, the comparator circuit 50 or 52 will generate an output pulse through the NAND gate 94 or 94', NAND gates 100 and 104 thus setting the flip flop circuit and indicator circuits 114 and 128 in the desired fashion. The system will then continue to monitor the remaining sensors in the system.

From the foregoing, it can be seen that the present invention provides a simple, relatively inexpensive and yet totally effective means for monitoring the status of a plurality of remote sensors, each which has a predetermined electrical characteristic, such as resistance.

Having described my invention, however, many modifications thereto will become apparent to those skilled in the art to which it pertains without deviation from the spirit of the invention as defined by the scope of the appended claims.

I claim:

1. A device for monitoring the condition of a plurality of remote stations comprising:

a plurality of remote sensors, each sensor comprising a resistor having one end connected to a preset voltage level, at least one sensor associated with each remote station, means for sequentially measuring said electrical characteristic of each sensor comprising, means for generating a waveform to each sensor resistor, said waveform comprising alternating first and second pulse trains, said first pulse train having a plurality of voltage pulses of a first predetermined amplitude and said second pulse train having a plurality of voltage pulses of a second predetermined amplitude, said first and second amplitudes being different from each other, means for detecting a voltage differential across each sensor resistor, means for comparing each measured voltage differential from said sensors with a predetermined value and for generating an output signal when said measured voltage differential from any one sensor differs from said predetermined value by a predetermined amount, means responsive to said comparing means output signal for identifying said one sensor wherein said comparing means comprises a first and second voltage comparator each having two inputs and an output, means for electrically connecting said voltage differential to one input of each comparator, a predetermined voltage source electrically connected to the other input of said comparator, a further predetermined voltage source electrically connected to the other input of said second comparator, switch means for electrically connecting said first comparator output to said identifying means only when said voltage pulse in said waveform is of said first amplitude and for electrically connecting said second comparator output to said identifying means only when said voltage pulse on said waveform is of said second amplitude.

2. The invention as defined in claim 1 and comprising a memory corresponding to each sensor, means for selectively storing a value in each of said memories, and means for disabling said comparator means output when the value in the memory associated with the sensor being measured by said measuring means equals a predetermined value.

3. The invention as defined in claim 1 wherein said measuring means comprises a counter, means for generating a voltage pulse train in synchronism with said counter, a switch associated with each sensor, each said switch having one pole connected to its associated sensor and its other pole connected to said voltage pulse train, and means for selectively actuating said switches independence upon the count in the counter.

4. The invention as defined in claim 3 and comprising a memory associated with each switch, means for disabling said comparing means output signal when the memory associated with the actuated switch equals a predetermined value, and means for selectively setting said memories to said predetermined value.

5. The invention as defined in claim 3 wherein said identifying means comprises means for displaying the count in the counter.

6. The invention as defined in claim 5 wherein said identifying means comprises means for displaying at least two counts in the counter at a spaced time interval.

7. The invention as defined in claim 4 wherein said setting means comprises a keyboard, a shift register for receiving a count from the keyboard, means for comparing the count in the keyboard with the count in the counter and for generating an output signal, and means responsive to said last mentioned output signal for storing a value in said memory.

* * * * *

UNITED STATES PATENT AND TRADEMARK OFFICE

CERTIFICATE OF CORRECTION

PATENT NO. : 4,549,168

DATED : October 22, 1985

INVENTOR(S) : Ryszard Sieradzki

It is certified that error appears in the above-identified patent and that said Letters Patent are hereby corrected as shown below:

In the abstract, line 2, after "stations" insert --which--.

Column 8, line 26, claim 3, delete "independence upon" and insert --independent from--.

Signed and Sealed this

Twenty-eighth Day of October, 1986

[SEAL]

*Attest:*

DONALD J. QUIGG

*Attesting Officer*

*Commissioner of Patents and Trademarks*